US005301093A

United States Patent [19]

Baggio

[11] Patent Number: 5,301,093

[45] Date of Patent: Apr. 5, 1994

[54] FLUORESCENT HANDLAMP

[75] Inventor: Horacio A. Baggio, Niles, Ill.

[73] Assignee: Woodhead Industries, Inc., Buffalo Grove, Ill.

[21] Appl. No.: 993,660

[22] Filed: Dec. 21, 1992

[51] Int. Cl.[5] ..... F21S 3/00

[52] U.S. Cl. ..... 362/223; 362/260; 362/267

[58] Field of Search ..... 362/260, 223, 267, 376, 362/217

[56] References Cited

U.S. PATENT DOCUMENTS

| | | | |
|---|---|---|---|
| D. 322,680 | 12/1991 | Baggio . | |
| 2,228,680 | 1/1941 | Tornblom | 362/376 |
| 4,352,539 | 10/1982 | Vest | 362/221 |
| 4,583,154 | 4/1986 | Haller | 362/376 |
| 4,663,697 | 5/1987 | Stearns et al. | 362/260 |
| 4,723,200 | 2/1988 | Troen | 362/260 |
| 4,958,267 | 9/1990 | Baake | 362/260 |
| 5,170,332 | 12/1992 | Browne | 362/376 |

FOREIGN PATENT DOCUMENTS 0042362 12/1981 European Pat. Off. ..... 362/260

OTHER PUBLICATIONS

One page brochure—Explosion Proof Fluorescent Portable Inspection Light Tubular Type (Stewart R. Brown Mfg. Co., Inc.) Date Unknown.

*Primary Examiner*—Richard A. Bertsch
*Assistant Examiner*—Michael I. Kocharov
*Attorney, Agent, or Firm*—Emrich & Dithmar

[57] ABSTRACT

An improved portable handlamp has a fluorescent lamp mounted in a lens assembly. A flexible elastomer handle mounted to the base of the lens assembly provides a cavity for receiving a ballast in an interference fit. The ballast is connected to the lamp holder by a bracket which also serve to mount the actuating switch in a manner such that these components form a frame permitting the user to grasp the handle and maneuver the handlamp.

7 Claims, 2 Drawing Sheets

FLUORESCENT HANDLAMP

FIELD OF THE INVENTION

The present invention relates to portable electric handlamps; and more particularly, it relates to an improved handlamp using a fluorescent lamp for illumination.

BACKGROUND OF THE INVENTION

Electrical handlamps using incandescent lamps have been known for decades. These lamps have certain disadvantages in that they tend to become very hot during continued use, and most commercially available incandescent lamps are not well-suited to the rugged conditions of use of most handlamps, particularly those used in industrial and commercial applications. If a handlamp with an incandescent lamp is dropped, almost invariably the filament will break and the lamp must be replaced.

Fluorescent handlamps are also known. In one commercial fluorescent handlamp, the ballast is incorporated directly into the electrical power cord which feeds the handlamp, so that there is a longer section of cord between the ballast and the handlamp itself. A shorter section of electrical cord extends between the ballast and the outlet receptacle to which the plug is connected for use.

Although this device provides the advantages of greater efficiency and less heat build up than with incandescent lamps, it is somewhat cumbersome in that the ballast must be dragged around the floor. Further, the ballast, which is not light, must be supported. This limits portability and maneuverability. Finally, this system is difficult to service in the field if it is required to replace the ballast or other component.

There has also been a handlamp in which a ballast is included directly in the handlamp itself. This is an explosion-proof handlamp in which the handle of the lamp is a metal casing; and the ballast is incorporated into the metal handle and securely embedded in a potting compound within the handle. This explosion-proof construction is prohibitively expensive for ordinary commercial and industrial usage, and it is quite heavy, and, thus, not easily maneuvered or hung from a support.

The present invention overcomes these disadvantages and provides a simple and reliable handlamp, yet one which is economical to manufacture and easily serviced in the field without the need for special tools.

SUMMARY OF THE INVENTION

The present invention provides an integral fluorescent handlamp in which the fluorescent lamp is mounted in a tubular lens assembly, and received in a lamp holder which, in turn, is snugly received in and held by a coupling collar which connects the lens assembly to a handle of elastomeric material. The handle is hollow to provide a cavity for receiving a ballast having a metal casing. The cavity of the handle and the ballast are sized such that opposing sides of the ballast engage and are firmly held by the inner wall of the flexible handle.

An intermediate mounting bracket connects the adjacent ends of the ballast and the lamp holder. The intermediate bracket also serves to mount the actuating switch, the plunger of which is aligned with a button formed in the handle. A terminal block serves to connect the wires from the cordset to the ballast and the fluorescent lamp; and a watertight compression connector couples the electrical cord to the rear end of the handle, thereby providing a water resistant enclosure for the ballast and switch.

The structure of the metal casing of the ballast, the intermediate mounting bracket and the lamp holder form a frame such that when a user grasps the handle, he also grasps the metal casing of the ballast and may hold and maneuver the handlamp as a solid unit. Thus, the present invention provides a fluorescent handlamp as an integral unit wherein the ballast is mounted in a rubber handle and forms part of the frame for holding and maneuvering the unit. Moreover, the handle is easily removable and the individual components may be repaired or replaced in the field without the need for special tools.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
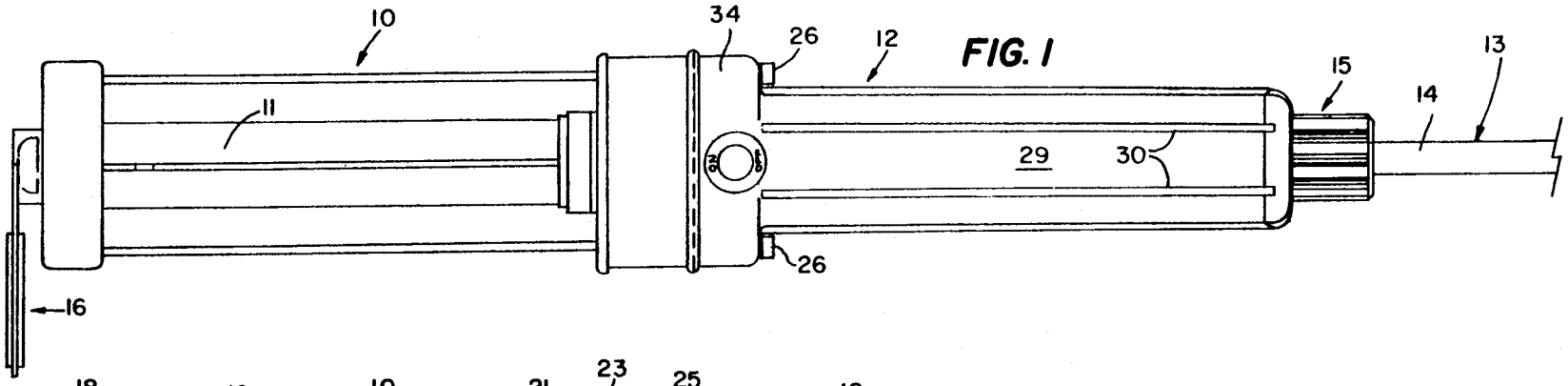
FIG. 1 is an elevational side view of a fluorescent handlamp constructed according to the present invention, with the plug end of the power cord removed for brevity.

Referring first to FIG. 1, there is shown a fluorescent handlamp including a lens assembly generally designated 10, a fluorescent lamp 11, a handle generally designated 12, and a cordset 13. The cordset 13 may be conventional and includes a plug (not shown for brevity) which may be connected to a conventional electrical wall socket, a multi-wire sheathed cable 14 and a water-resistant connector 15 which couples the cable 14 to the base of the handle 12.

A hook generally designated 16 is connected to the distal end of the lens assembly 10 so that the handlamp may be suspended from a hook or support line, if desired. The hook 16 may be polypropylene or a vinyl-coated metal, if desired.

Figure 2:
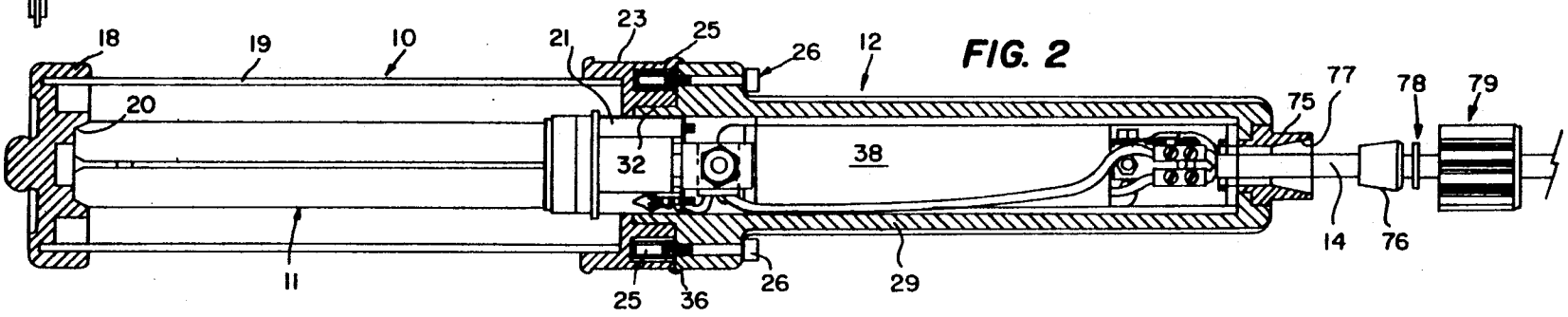
FIG. 2 is a longitudinal cross-sectional view of the handlamp of FIG. 1 taken through the mid-section in a plane parallel to the plane of the page of FIG. 1.
Figure 3:
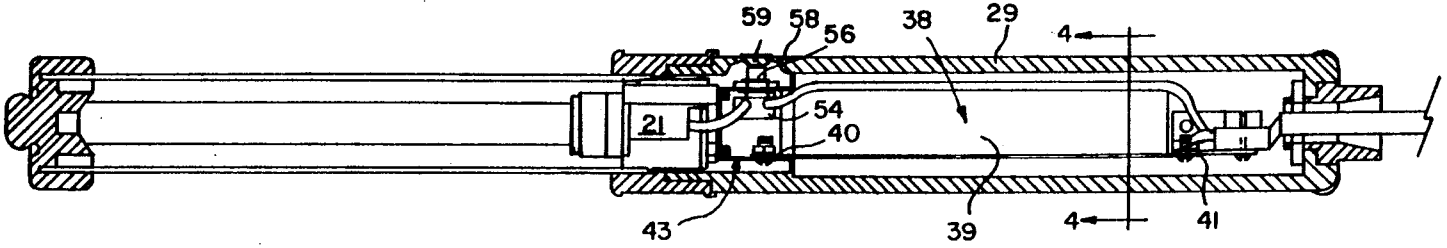
FIG. 3 is a transverse longitudinal cross-sectional view of the handlamp of FIG. 1 taken through the site line 3—3 thereof.

Turning now to FIGS. 2 and 3, the lens assembly 10 includes a molded top cap 18 in which there is formed a recess for receiving one end of a transparent tubular lens 19. The lens 19 may be made of a clear, break-resistant plastic such as butyrate or polycarbonate. The lens tube 19 surrounds entirely the fluorescent lamp 11 to provide 360° of illumination, although a reflector may be included within the lens assembly, if desired. In the illustrated embodiment, the fluorescent lamp is a PL-13 lamp having parallel tubular sections, as seen in FIG. 2.

The inboard end of the top cap 18 is provided with a recess designated 20 for receiving the distal end of the lamp 11. For reference, "distal" refers to the location furthest from the hand of an operator grasping the handle, and "proximal" refers to that end of an element closest to the hand of an operator grasping the handle 12. The base of the lamp 11 is received in a conventional lamp holder 21.

A coupling collar 23 has a cup-shaped recess for receiving the proximal end of the lens tube 19; and it also has a central opening for receiving the lamp holder 21. Two internally threaded sleeves 25 are imbedded in the coupling collar 23 for receiving corresponding screws 26 which connect the handle 12 to the coupling collar 23.

The handle 12 includes a tubular outer shell 29 which may be ribbed as at 30 in FIG. 1, and which has a leading lip 32 which fits between a portion of the lamp holder 21 and the rear, inner section of the coupling collar 23. The distal end of the shell 29 is provided with an enlarged, peripheral section 34 conforming to the outer perimeter of the coupling collar 23. A peripheral rib 36 formed on the proximal end of the coupling collar bridges over and covers the junction between the coupling collar and the distal edge of the handle 12.

The end cap 18, coupling collar 23 and shell 29 are all preferably formed of a moldable elastomer such as rubber. Rubber is durable, non-conducting, waterproof and forms water-resistant seals under pressure. Moreover, it absorbs shock and, as we explained below, its flexibility affords particular advantages in the instant invention. A conventional ballast generally designated 38 in FIG. 2 is received within and entirely surrounded by the shell of handle 29. The ballast is enclosed within a metal casing 39 in FIG. 3 and has first and second mounting tabs 40, 41 projecting from opposing sides of the same surface (which may be considered the bottom surface as seen in FIG. 3). The tabs 40, 41 are conventionally used to mount the ballast 38.

Figure 6:
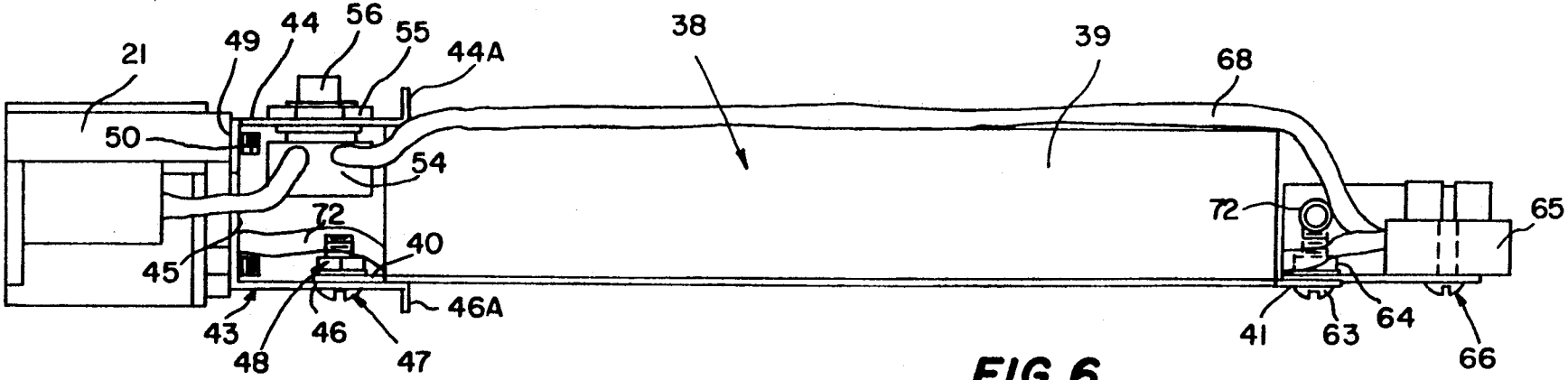
FIG. 6 is an enlarged view of the interior frame of the handlamp as seen in FIG. 3.

A C-shaped bracket (or U-shaped, depending upon the perspective of the observer), designated 43, connects the base of the lamp holder 21 to the adjacent end of the casing 39 of the ballast 38. Referring particularly to FIG. 6, the bracket 43 includes an upper leg 44, a connecting leg 45 and a lower leg 46, connected in a C-shape as indicated. The legs 44, 46 are spaced to extend above and below the casing 39 of the ballast so that the distal ends of these legs are braced against the ballast casing. The lower leg 46 contains an aperture which is aligned with a corresponding aperture on the tab 40 of the ballast casing, and the leg 46 and tab 40 are connected together by means of a set screw 47 and nut 48. The bracket 43 is sometimes referred to as the "intermediate" bracket to distinguish it from the terminal mounting bracket, to be described subsequently, and because it is located between the ballast and the lamp holder.

Figure 5:
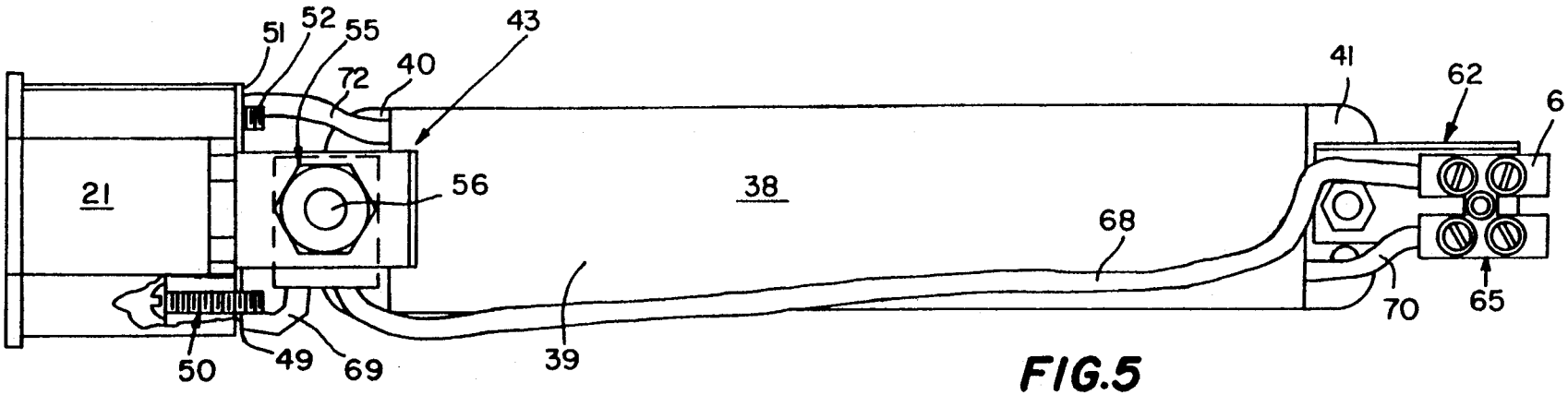
FIG. 5 is an enlarged view of the interior frame of the handlamp as seen in FIG. 2.

Referring now to FIG. 5, the intermediate leg 45 contains an upper tab (as seen in FIG. 6) and designated 49 which extends out of the plane of the page and threadably receives a screw 50 (see FIG. 5) which secures the base of lamp holder 21 to the intermediate bracket 43. A similar tab 51 extends into the plane of the page of FIG. 6 and is located toward the bottom of the intermediate leg 45 for threadably receiving a second mounting screw 52 which secures the bracket to the lamp holder. The screws 50, 52 are located diagonally opposite each other relative to the lamp holder.

Still referring to FIG. 6, a switch 54 is mounted to the leg 44 of the intermediate bracket 43 by means of a nut 55. The switch 54 includes an actuating plunger 56. As best seen in FIG. 3, the handle shell 29 has an annular region of reduced thickness designated 58, surrounding the plunger 56 of the switch 54. At the center of the thinned peripheral region 58, is a button 59 of increased thickness which is aligned with the switch plunger 56. When the button 59 is depressed, it also depresses the plunger 56, with the thinned area 58 acting as a membrane, permitting the necessary reciprocating action of the button 59.

Figure 4:
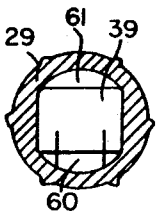
FIG. 4 is a transverse cross-sectional view taken through the site line 4—4 of FIG. 3.

Returning to FIG. 6, the distal ends of the legs 44, 46 are provided with feet designated 44A, 46A, respectively, and as can be seen in FIG. 3, the feet 44A, 46A help to stabilize the intermediate bracket 43 relative to the inner surface of the shell 29 of the handle. This helps to secure the switch during actuation, and it also braces the rigid structure comprised of the lamp holder 21, bracket 43 and ballast 38, against the flexible shell of the handle. Moreover, as best seen in FIG. 4, the sides of the casing 39 and the inner dimension of the shell 29 of the handle are such that when the ballast is inserted into the shell, the shell deforms slightly and fully engages the opposing lateral sides of the shell 29 in an interference fit, thereby further stabilizing the ballast within the handle, while leaving upper and lower spaces, such as are designated 60, 61 in FIG. 4 for routing wires.

Turning now to FIGS. 5 and 6, a terminal mounting bracket 62 is mounted to the tab 41 of the ballast casing 39 by means of a screw 63, washer and a nut 64. A two-pole terminal block 65 is mounted to the terminal bracket 62 by means of a screw 66.

The terminal block 65 is adapted to connect two pairs of wires together. The terminals on the right side receive the incoming power leads. One of the remaining terminals connects a wire 68 between an incoming power line and the switch 54. The switch 54, in turn, is connected to the lamp holder 21 by means of a wire 69. The other incoming lead is connected to the ballast via the terminal 65 and a wire 70. The other terminal of the ballast 38 is coupled to the lamp holder 21 by means of a wire 72, seen in FIG. 5. The third incoming wire, which is a true ground, may be connected to the terminal mounting bracket 62 by means of a screw 72, seen in FIG. 6.

Returning now to FIGS. 2 and 3, at the base end of the shell 29 of the handle, there is mounted a body 75 of the compression fitting 15. The body 75 has a central aperture which receives the cable 14, the three incoming wires being seen in FIG. 2 where the sheath of the cable 14 is stripped away, after the cable is fed into the interior cavity of the handle. Before the cable is fed into the handle, a flexible grommet 76 having a frusto-conical outer surface is placed on the wire, and it is fit into the base end of the connector body 75 which has a corresponding frusto-conical surface 77. A washer 78 is also placed on the cable behind the grommet 76, and a compression nut 79 is received on the cable and is received on the externally threaded surface 80 of connector body 75, compressing the grommet 76 into sealing engagement with the surface 77.

It will thus be appreciated that the present invention provides for a rugged, durable and reliable, yet economical handlamp suitable for use in industrial and commercial environments which employ a fluorescent lamp for extended, economical use, and which provides that the ballast is integrally mounted within the handlamp itself and serves as part of a framework for holding and maneuvering the handlamp. Further, using only tools normally readily available at the sites at which such handlamps are typically used, the compression fitting may be loosened and the screws 26 removed so that the handle 12 may be slid over the cable to service or replace the main components of the handlamp, such as the lamp, ballast or switch. Even the terminal block may be replaced using only a screw driver because the brackets and components are mounted using screws rather than more permanent fasteners such as rivets.

Having thus disclosed a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In a fluorescent handlamp including a lamp holder; a fluorescent lamp received in said lamp holder; a tube assembly having a transparent lens surrounding said lamp; a collar with a central opening for receiving said lamp; a switch connected in circuit with said lamp; and a cordset having a plurality of wires for coupling electrical power to said handlamp, the improvement comprising: an elastomeric handle having an elongated cavity and coupled to said collar at one end and receiving said cordset at the other end; a ballast having a metal outer casing with first and second ends and received in said cavity of said handle and extending lengthwise thereof, said ballast casing and said handle being sized such that said casing engages and is held by opposing sides of the interior wall of said cavity whereby a person gripping the handle will also grip said casing; a first mounting bracket connecting said lamp holder to said ballast casing at one end thereof; a second mounting bracket connected to said ballast casing at the other end thereof; and a wire terminal mounted to said second mounting bracket for connecting wires from said cordset respectively to said ballast and to said switch.

2. The apparatus of claim 1 wherein said lens has a distal end remote from said handle and said tube assembly further includes an end cap having a recess for receiving the distal end of said lens and a central recess for receiving and supporting the distal end of said lamp, and a coupling collar receiving and securing the proximal end of said lens, said coupling collar being connected to the adjacent end of said handle; and a lens holder received in said coupling collar and providing an electrical socket for said lamp.

3. The apparatus of claim 2 wherein said first bracket has a general C-shape with first and second legs and an intermediate leg, said intermediate leg being connected to said lamp holder, and said first and second legs engaging and abutting opposing surfaces of said ballast casing, one of said first and second legs being mounted to an extension of said ballast casing.

4. The apparatus of claim 3 wherein said switch includes a plunger mounted to said second leg of said first bracket and is actuatable to energize and deenergize said lamp, said handle defining a thinned, membrane annular section surrounding said plunger and having a thickened button portion directly above said plunger whereby when said button is actuated, said membrane will flex and permit said plunger to be actuated.

5. The apparatus of claim 4 wherein said wire terminal has a plurality of connectors for connecting, respectively, a power wire of said plurality of wires to said switch, and a common wire of said cord set to said ballast, said ballast and switch being connected in circuit with said lamp holder and said lamp.

6. The apparatus of claim 5 further comprising a water-resistant compression fitting for securing said cord set to the end of said handle and including a base member secured to said handle and extending therethrough, a flexible grommet and a compression nut forcing said grommet into said base member to seal said cord thereagainst and provide resistance to water entering said handle.

7. In a fluorescent handlamp including a fluorescent lamp mounted in a lamp holder; a lens assembly having a transparent lens at least partially surrounding said lamp; and a cordset having a plurality of wires for coupling electrical power to said handlamp, the improvement comprising: a flexible handle having an elongated cavity and coupled to said assembly at one end and receiving said cordset; a ballast having a metal outer casing with first and second ends and received in said cavity of said handle and extending lengthwise thereof, said ballast casing and said handle being sized such that said casing engages and is held by opposing sides of the interior wall of said cavity whereby a person gripping the handle will also grasp said casing; a mounting bracket having an intermediate leg and at least first and second end legs extending respectively from opposing ends of said intermediate leg; a first removable fastener connecting said intermediate leg of said bracket to said lamp holder; a second removable fastener connecting said first leg to said ballast casing; a switch removably mounted to said second leg of said bracket; and terminal mounting means removably mounted to said ballast casing for electrically connecting said wires of said cordset respectively to said lamp and one of said switch and ballast, said ballast, lamp, switch and wires being connected in operative electrical circuit.

* * * * *